US006100629A

United States Patent [19]

Han et al.

[11] Patent Number: 6,100,629

[45] Date of Patent: Aug. 8, 2000

[54] PANEL ASSEMBLY FOR CATHODE RAY TUBE WITH VIBRATION DAMPING MEMBER

[75] Inventors: Dong-hee Han; Sung-hwan Moon, both of Suwon-si; Seung-kwon Han, Seoul, all of Rep. of Korea

[73] Assignee: Samsung Display Devices Co., Ltd., Suwon-si, Rep. of Korea

[21] Appl. No.: 09/203,544

[22] Filed: Dec. 1, 1998

[30] Foreign Application Priority Data

Dec. 1, 1997 [KR] Rep. of Korea ..... 97-65011

[51] Int. Cl.[7] ..... H01J 29/80

[52] U.S. Cl. ..... 313/404; 313/402; 313/405; 313/406

[58] Field of Search ..... 313/402, 404, 313/405, 406

[56] References Cited

U.S. PATENT DOCUMENTS

| | | | |
|---|---|---|---|
| 4,857,795 | 8/1989 | Wakita et al. | 313/402 |
| 5,103,132 | 4/1992 | Van Der Bolt et al. | 313/402 |
| 5,289,080 | 2/1994 | Park | 313/402 |
| 5,451,833 | 9/1995 | Tong | 313/402 |

*Primary Examiner*—Michael H. Day
*Assistant Examiner*—Karabi Guharay
*Attorney, Agent, or Firm*—Christie, Parker & Hale, LLP

[57] ABSTRACT

A panel assembly for a cathode ray tube includes a panel having an inner phosphor screen and a side-wall, and a shadow mask having a plurality of beam-guide apertures. The shadow mask is placed behind the phosphor screen at a predetermined distance. A shadow mask frame is attached under the shadow mask to suspend it in the panel. The panel assembly further includes a plurality of stud pins embedded into the side-wall of the panel, a spring positioned between the shadow mask frame and the stud pins to interconnect them, and a vibration damping member for damping vibration of the shadow mask by converting mechanical stress applied to the shadow mask into electrical energy. The vibration damping member is formed with piezoelectric material layers provided on at least one of an outer periphery of the stud pin and between the spring and mask frame.

5 Claims, 1 Drawing Sheet

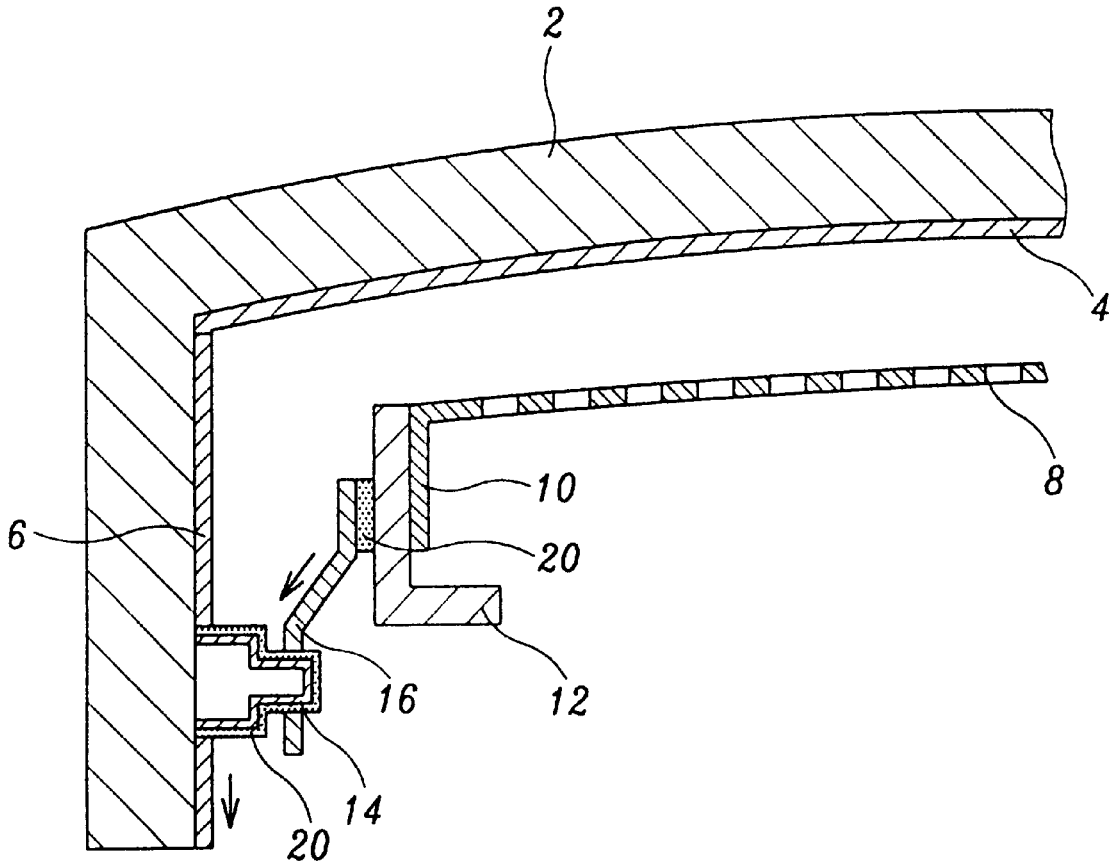
2
4
8
10
6
20
16
12
14
20

PANEL ASSEMBLY FOR CATHODE RAY TUBE WITH VIBRATION DAMPING MEMBER

CROSS REFERENCE TO RELATED APPLICATION

This application is based on application No. 97-65011 filed in Korean Industrial Property Office on Dec. 1, 1997, the content of which is incorporated hereinto by reference.

FIELD OF THE INVENTION

The present invention relates to a panel assembly for a cathode ray tube (CRT) and, more particularly, to a CRT panel assembly realizing an improved picture quality by minimizing vibration of a shadow mask.

BACKGROUND OF THE INVENTION

Generally, CRTs are designed to reproduce picture images on a panel screen by exciting phosphors, coated on the screen, with electron beams emitting from an electron gun and passing through apertures of a color-selecting shadow mask.

The shadow mask ensures that each electron beam lands on the correct phosphor. The shadow mask is welded to a shadow mask frame connected to stud pins embedded into a side wall of the panel by interposing springs therebetween.

The shadow mask comprises a very thin metal plate having a plurality of beam-guide apertures, and is extremely susceptible to vibration even at a minimal shock or impact from the external, or a sound wave from a built-in speaker. During such a vibration, electron beams deviate from their correct courses and land on inappropriate phosphors or black matrix portions, deteriorating color purity.

In order to overcome the aforementioned problem, various proposals have been made. For example, the welding position of the spring and the shadow mask frame, or the coupling position of the spring and the stud pin is changed to stop vibration in the transmitting course of the stud pin, the spring and the mask frame. However, such type of technique cannot be well adapted to coping with various vibration sources and amplitudes.

In contrast, it is also proposed to minimize vibration of the shadow mask by strengthening the rigidity thereof. However, this technique involves a difficult forming process, resulting in high production cost.

SUMMARY OF THE INVENTION

It is an object of the present invention to provide a CRT panel assembly realizing an improved picture quality by minimizing vibration of a shadow mask.

It is another object of the present invention to provide a CRT panel assembly well adapted to coping with various vibration sources and amplitudes.

It is still another object of the present invention to provide a CRT panel assembly having a vibration damping member for damping vibration of a shadow mask by converting mechanical stress applied to the shadow mask into electrical energy.

In order to achieve these objects, the CRT panel assembly includes a panel having an inner phosphor screen and a side-wall, and a shadow mask having a plurality of beam-guide apertures. The shadow mask is placed behind the phosphor screen at a predetermined distance. A shadow mask frame is attached under the shadow mask to suspend it in the panel.

The CRT panel assembly further includes a plurality of stud pins embedded into the side-wall of the panel, a plurality of springs positioned between the shadow mask frame and the stud pins to interconnect them, and a vibration damping member for damping vibration of the shadow mask by converting mechanical stress applied thereto into electrical energy.

The vibration damping member is formed with piezoelectric material layers provided on at least one of an outer periphery of the stud pin and between the spring and shadow mask frame.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawing, wherein:

The FIGURE is a cross-sectional view of a fragment of a CRT panel assembly according to a preferred embodiment of the present invention.

DETAILED DESCRIPTION OF THE INVENTION

Reference will now be made in detail to the preferred embodiments of the present invention, an example of which is illustrated in the accompanying drawing.

The FIGURE is a cross-sectional view of a fragment of a CRT panel assembly according to a preferred embodiment of the present invention. The CRT panel assembly includes a panel 2 having an inner phosphor screen 4 and a side-wall coated with a graphite layer 6, and a shadow mask 10 having a plurality of beam-guide apertures 8. The shadow mask 10 is placed behind the phosphor screen 4 at a predetermined distance. A shadow mask frame 12 is attached under the shadow mask 10 to suspend the mask 10 in the panel 2.

The panel assembly further includes a plurality of stud pins 14 embedded into the side-wall of the panel 2. The shadow mask frame 12 is connected to each of the stud pins 14 by interposing a spring 16 therebetween.

The spring 16 is formed with a bimetal element, consisting of two metals of different thermal expansion riveted or welded together. One end of the spring 16 is welded to the shadow mask frame 12 while the opposite end is removably engaged with the stud pins 14. The spring 16 compensates for thermal expansion of the shadow mask 10 to adequately keep it at the correct position.

However, with only the aforementioned structure, the shadow mask 10 is liable to vibrate due to the mechanical stress applied thereto.

Accordingly, a novel vibration damping member 20 is provided in the shadow mask suspending structure. The vibration damping member 20 utilizes a piezoelectric effect where electric polarization is generated as a result of the application of mechanical stress. In order to achieve such an effect, a piezoelectric material layer is used to form the vibration damping member 20.

The piezoelectric material layer 20 is formed with piezoelectric materials such as $BaTiO_3$, $PbZrO_3$, $PbTiO_3$, or a mixture of $PbTiO_3$ and $PbZrO_3$.

In the preferred embodiment, the piezoelectric material layer 20 is at least partially provided on the outer periphery of the stud pin 14 and/or between the spring 16 and mask frame 12. In addition, the piezoelectric material layer 20 can be formed on various other portions in the panel assembly.

In order to form such a piezoelectric material layer 20, a paste of piezoelectric material compounds is first prepared. Then, the paste is painted or coated on the required places. Alternatively, an ordinary piezoelectric material sheet may be attached on those places.

With the piezoelectric material layer 20, the mechanical stress applied to the shadow mask 10 is converted into electrical energy. The electrical energy flows out along the internal grounding course of the stud pin 14 and the internal graphite layer 6, resulting in dissipation of the mechanical stress. The piezoelectric material layer 20 can thereby largely reduce the degree of mechanical stress applied to the shadow mask 10 and, as a result, minimize vibration of the shadow mask 10.

As described above, the CRT panel assembly according to the present invention can realize an improved picture quality by dissipating mechanical stress applied to the shadow mask through converting it into electrical energy.

It will be apparent to those skilled in the art that various modifications and variations can be made in the CRT panel assembly of the present invention without departing from the spirit or scope of the invention. Thus, it is intended that the present invention covers modifications and variations of this invention provided they come within the scope of the appended claims and their equivalents.

What is claimed is:

1. A panel assembly for a cathode ray tube, comprising:

a panel having an inner phosphor screen and a side-wall;

a shadow mask having a plurality of beam-guide apertures, the shadow mask being positioned behind the phosphor screen at a predetermined distance;

a shadow mask frame attached to the shadow mask to suspend the shadow mask in the panel;

a stud pin embedded into the side-wall of the panel;

a spring positioned between the shadow mask frame and the stud pin to interconnect the shadow mask frame and the stud pin; and a vibration damping member for damping vibration of the shadow mask by converting mechanical stress applied to the shadow mask into electrical energy.

2. The panel assembly for a cathode ray tube of claim 1 wherein the vibration damping member comprises a piezoelectric material layer.

3. The panel assembly for a cathode ray tube of claim 2 wherein the piezoelectric material layer is provided between the spring and the shadow mask frame.

4. The panel assembly for a cathode ray tube of claim 2 wherein the piezoelectric material layer is provided on an outer periphery of the stud pin.

5. The panel assembly of claim 2 wherein the piezoelectric material layer is formed with a material selected from the group consisting of $BaTiO_3$, $PbZrO_3$, $PbTiO_3$, and a mixture of $PbTiO_3$ and $PbZrO_3$.

* * * * *